US008970387B2

(12) United States Patent
Brigham et al.

(10) Patent No.: US 8,970,387 B2
(45) Date of Patent: Mar. 3, 2015

(54) SMOKE DETECTOR

(75) Inventors: Peter Brigham, Coventry (GB); Stuart Hart, Coventry (GB)

(73) Assignee: Sprue Safety Products Ltd., London (GB)

( * ) Notice: Subject to any disclaimer, the term of this patent is extended or adjusted under 35 U.S.C. 154(b) by 103 days.

(21) Appl. No.: 13/642,389

(22) PCT Filed: Apr. 20, 2011

(86) PCT No.: PCT/GB2011/000615
§ 371 (c)(1),
(2), (4) Date: Dec. 12, 2012

(87) PCT Pub. No.: WO2011/131938
PCT Pub. Date: Oct. 27, 2011

(65) Prior Publication Data

US 2013/0093594 A1 Apr. 18, 2013

(30) Foreign Application Priority Data

Apr. 21, 2010 (GB) ..... 1006683.5

(51) Int. Cl.
*G08B 17/10* (2006.01)

(52) U.S. Cl.
USPC ..... 340/628; 340/630

(58) Field of Classification Search
USPC ..... 340/600, 618, 627, 628, 630, 632; 250/273, 574, 582, 287; 702/85
See application file for complete search history.

(56) References Cited

U.S. PATENT DOCUMENTS

| | | | | |
|---|---|---|---|---|
| 5,751,218 | A | 5/1998 | Winterble et al. | |
| 6,166,648 | A * | 12/2000 | Wiemeyer et al. | 340/630 |
| 6,756,905 | B2 * | 6/2004 | Rattman et al. | 340/630 |
| 7,106,187 | B2 * | 9/2006 | Penney et al. | 340/514 |
| 7,463,159 | B2 * | 12/2008 | Hess et al. | 340/630 |
| 7,616,126 | B2 * | 11/2009 | Kadwell et al. | 340/630 |
| 7,778,043 | B2 * | 8/2010 | Rosenblatt | 361/809 |
| 8,610,586 | B2 * | 12/2013 | Shimada et al. | 340/627 |

FOREIGN PATENT DOCUMENTS

| | | |
|---|---|---|
| EP | 0618555 A2 | 10/1994 |
| EP | 1903524 | 3/2008 |

(Continued)

OTHER PUBLICATIONS

International Preliminary Report on Patentability issued in International Patent Application No. PCT/GB2011/000615 dated Jul. 30, 2012.
Search Report issued in Application No. GB1006683.5 on Aug. 24, 2010.
Notice of Reasons for Rejection issued in Japanese Patent Application No. 2013-505529 on Oct. 14, 2014.

*Primary Examiner* — Van T. Trieu
(74) *Attorney, Agent, or Firm* — Barnes & Thornburg LLP

(57) ABSTRACT

An alarm for detecting smoke comprises a housing (1) having vents (9) for allowing ingress of smoke into the housing. A sensor chamber (22,26) is disposed within the housing and has vents (24*a*,24*b*) for allowing ingress of smoke into the sensor chamber and comprises two parts. A diode emitter and diode sensor (25) is mounted within the sensor chamber for sensing light reflected off smoke. An alarm circuit (32), including detection means for detecting smoke sensed by the sensor diode (25), is supported on a printed circuit board (PCB) (29). The PCB is sandwiched between two halves (22 and 26) of the sensor chamber such that an edge (30) thereof extends part-way into said sensor chamber. The sensor is mounted on, near or adjacent to the edge.

12 Claims, 4 Drawing Sheets

(56) References Cited

FOREIGN PATENT DOCUMENTS

| | | |
|---|---|---|
| JP | 06-288917 | 10/1994 |
| JP | 09-091559 | 4/1997 |
| JP | 11-312286 | 11/1999 |
| JP | 2001134860 | 5/2001 |
| JP | 2001-266265 | 9/2001 |
| WO | WO 01/78031 | 10/2001 |
| WO | WO 2008/011413 A2 | 1/2008 |

* cited by examiner

SMOKE DETECTOR

CROSS REFERENCE TO RELATED APPLICATIONS

This patent application is a U.S. nationalization under 35 U.S.C. §371 of International Application No. PCT/GB2011/000615, filed Apr. 20, 2011, which claims priority to United Kingdom Patent Application No. GB1006683.5, filed Apr. 21, 2010. The disclosures set forth in the referenced applications are incorporated herein by reference in their entireties.

This invention relates to a smoke alarm for detecting smoke particularly for use in a household environment.

A typical conventional smoke alarm is battery-powered and comprises a housing consisting of a mounting plate and/or base and removable cover. The mounting plate of the housing is intended to be fitted directly to a flat surface, such as a ceiling, by means of screws or the like which pass through the base of the alarm. The removable cover, or a cover that pivots away to the side is provided so that access can be gained to the housing interior to change the battery. The components of the alarm are typically supported within the housing on a printed circuit board (PCB). The battery is commonly mounted by simply clipping onto a terminal pad. Along with the battery, one or more sensors is/are typically mounted on one side of the PCB together with other components of the alarm, including a sounder and control circuitry. The other side of the PCB is usually mounted to the base.

The base and/or removable cover are provided with vents to allow the ingress of smoke and/or other air pollutants for detection by the sensor(s). In addition where the alarm is a multi functional device there may be provided one or a number of buttons for the different functions and operations of the alarm. An alarm of this type is described in patent specification WO 2008/125834 A2.

A problem with alarms of this type is that the presence of the components on the PCB, as well as other features within the alarm enclosure, obstruct the flow of smoke to the sensor. One consequence is that the time taken for the alarm to detect smoke may vary depending on the direction of ingress of the smoke into the alarm. A solution to this problem has been proposed in patent specification WO 01/43097. This solution involves placing the sensor on the opposite side of the PCB to the other components of the device and positioning the PCB within the housing such that part of the sensor projects from of the housing towards a ceiling mounting plate. Attachments are provided for attaching the housing to the ceiling mounting plate such that a space is provided between the ceiling mounting plate and the housing, providing a flow path for the passage of smoke. Smoke flowing along this flow path can flow around the attachments and enter the sensor.

A problem with this solution is an increase in the complexity of the housing design and a need to attach components to both sides of the PCB. This increases manufacturing costs and results in a bulky and more obtrusive alarm profile.

It is an aim of the present invention to provide an alarm which has a more even responsiveness to the ingress of smoke into the device around its circumference, is more slimline and has a reduced manufacturing cost.

According to the present invention, there is provided an alarm for detecting smoke comprising: a housing having vents for allowing ingress of said smoke into the housing; a sensor chamber disposed within the housing and having vents for allowing ingress of said smoke into the sensor chamber, the sensor chamber comprising two parts; sensor means mounted within the sensor chamber; an alarm circuit including detection means for detecting said smoke when sensed by the sensor; and a printed circuit board (PCB) supported by the sensor chamber so that it is at least partially sandwiched between the two sensor chamber parts such that an edge thereof extends part way into said sensor chamber so as to divide the sensor chamber into two portions one disposed above the PCB and the other below the PCB, wherein said PCB has the alarm circuit and the sensor means mounted thereon and the sensor means is mounted on, near or adjacent to said edge.

The housing vents may be distributed around a periphery of the housing to define a substantially planar flow path for the passage of smoke through the housing. In this case, the sensor chamber is preferably provided with vents disposed to lie at least partly within the planar flow path whereby smoke entering the housing via the housing vents can flow along the planar flow path and into the sensor chamber. The PCB may be disposed parallel and adjacent to said planar flow path such that one of said chamber portions lies substantially within the planar flow path and the other chamber portion is offset relative to the planar flow path. The other portion of the sensor chamber may be substantially solid so that ingress of smoke into the chamber is by way of the vents that lie in the planar flow path.

The alarm housing advantageously has upper and lower portions which couple together to provide an enclosed space for housing a battery, and a sounder and, wherein the upper and lower portions are sized so that mounting of the battery and sounder to the upper portion is such that they lie substantially outside the planar flow path of the housing. The exterior surface of the housing, and the lower portion in particular, is preferably profiled to have an unobtrusive slim-line profile.

The sensor means may comprise a radiation emitting transducer for directing radiation into the sensor chamber and a radiation sensing transducer for sensing radiation reflected from smoke present in the sensor chamber.

According to the present invention, there is further provided a sensor chamber assembly for an alarm, the sensor chamber assembly comprising: vents for allowing ingress of smoke into the sensor chamber assembly; sensor means mounted within the sensor chamber; an alarm circuit including detection means for detecting said smoke when sensed by the sensor; and a printed circuit board (PCB) supported by the sensor chamber such that an edge thereof extends part way into said sensor chamber, wherein said PCB has the alarm circuit mounted thereon and the sensor means is mounted on, near or adjacent to said edge.

According to the present invention, there is further provided a method of calibrating a sensor chamber assembly for an alarm device having a housing, battery and sounder, the sensor chamber assembly comprising a sensor chamber having vents for allowing ingress of smoke into the sensor chamber, sensor means mounted within the sensor chamber, an alarm circuit including detection means for detecting said smoke when sensed by the sensor, and a printed circuit board (PCB) supported by the sensor chamber such that an edge thereof extends part way into said sensor chamber, wherein said PCB has the alarm circuit mounted thereon and the sensor means is mounted on, near or adjacent to said edge, the method comprising the step of simultaneously calibrating a plurality or multiplicity of said sensor chamber assemblies prior to installation within their respective housings alongside their respective batteries and sounders.

The alarm circuit, which may comprise a microprocessor for controlling operation of the alarm, is wired to the PCB and connected to a battery and a sounder in a manner known in the art.

The housing may be formed in upper and lower portions, 'upper' referring to a portion that is disposed closer to the ceiling when installed. The upper and lower portions couple together such as to provide an enclosed space for housing the components of the alarm. The upper portion is preferably provided with engagement means for interlocking engagement with corresponding members provided on a mounting plate which in turn has fixtures for facilitating mounting thereof to a ceiling. So, the alarm is affixed to a ceiling by first fixing the mounting plate to the ceiling and subsequently interlocking the housing thereto.

The upper portion may also provide a mounting surface for the battery and the sounder of the alarm as well as for the second portion of the sensor chamber. The lower portion of the housing comprises an aesthetically pleasing profiled cover for covering the components of the alarm. The vents that define the planar flow path are distributed about the circumferential periphery of the upper portion.

The mounting plate may have an upper surface and a through-opening for receiving a fixing such as a screw for fixing said mounting means to a generally flat surface. The through-opening may be elongate and have an enlarged portion for passage of the head of the fixing through the through-opening, a narrowed portion for retention of said head and a neck portion therebetween.

Embodiments of the present invention have the advantage that the quantity of PCB required is reduced as the battery and sounder are mounted to the housing, the PCB being substantially reserved for components of the alarm circuit. The PCB is effectively 'sandwiched' between the first and second portions of the sensor chamber such that the secondary vents are on one side and a solid chamber wall is provided on the other side. As the PCB extends only part way into the sensor chamber, the sensor or sensors may be positioned close to or within the flow path of smoke flowing along the planar flow path. This results in reduced manufacturing costs in terms of materials and constructional complexity. Sandwiching the PCB between two halves or portions of the sensor chamber creates a PCB-sensor chamber assembly that is easier to handle during production than prior art arrangements that mount the PCB separately from the sensor or sensor chamber. Moreover, provision of the alarm circuitry on the PCB-sensor chamber assembly makes it possible to calibrate more assemblies at one time in a calibration rig resulting in improved production. Embodiments of the present invention facilitate an alarm that combines neutral directional dependence and efficient breathing through a broadly unencumbered planar smoke flow from all orientations, while having an unobtrusive slim-line profile.

The invention will now be illustrated by way of description of an example of the present invention, with reference to the accompanying drawings, in which.

Figure 5:
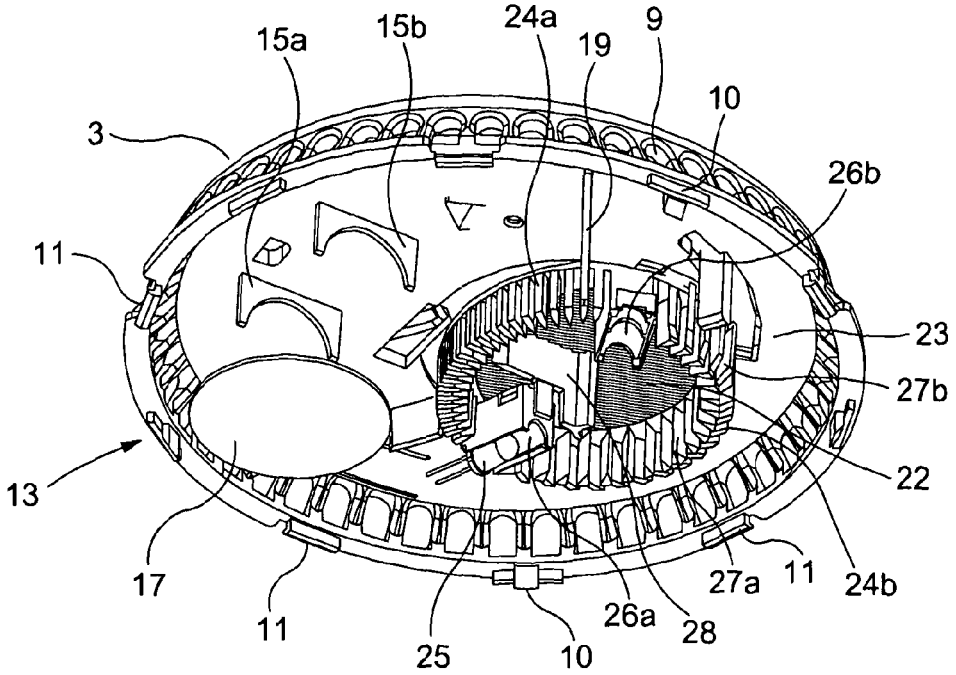
FIG. 5 is the view of FIG. 4 with the addition of part of a sensor chamber.
Figure 6A:
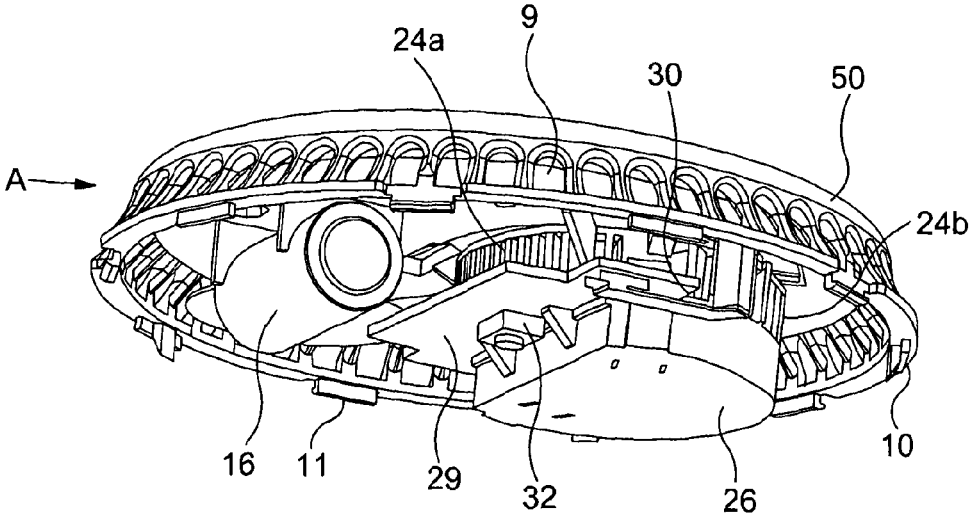
Figure 6B:
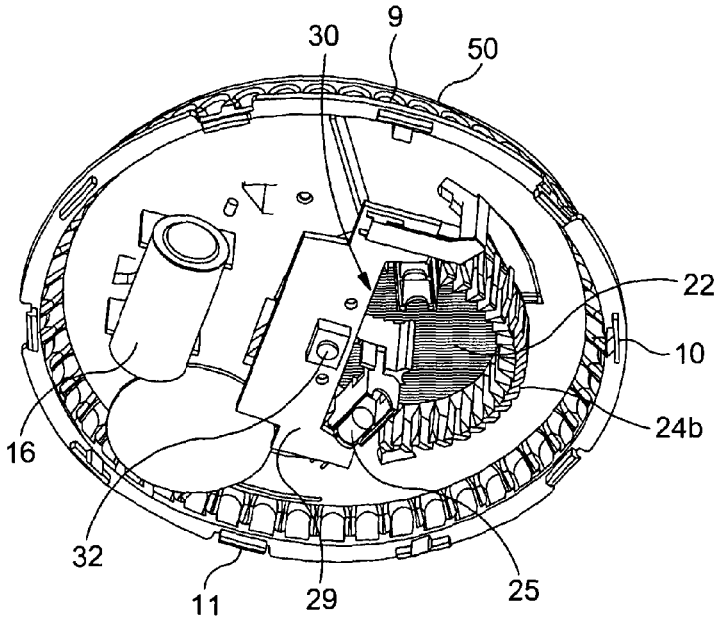
Figure 7:
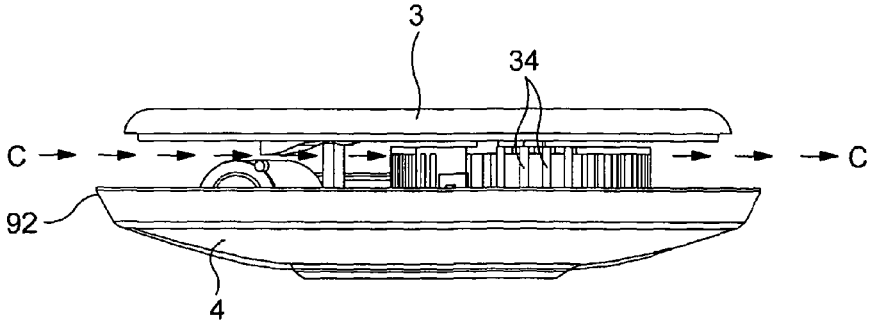

FIG. 6*a* is the view of FIG. 5 with the addition of a further part of the sensor chamber, printed circuit board and battery;

FIG. 6*b* is a view similar to FIG. 6*a* showing a half of the sensor chamber removed; and FIG. 7 is a side view of the alarm of the preceding figures with the primary vents of the upper portion removed to show secondary vents of the sensor chamber and a flow path for smoke passing through the device.

Figure 1:
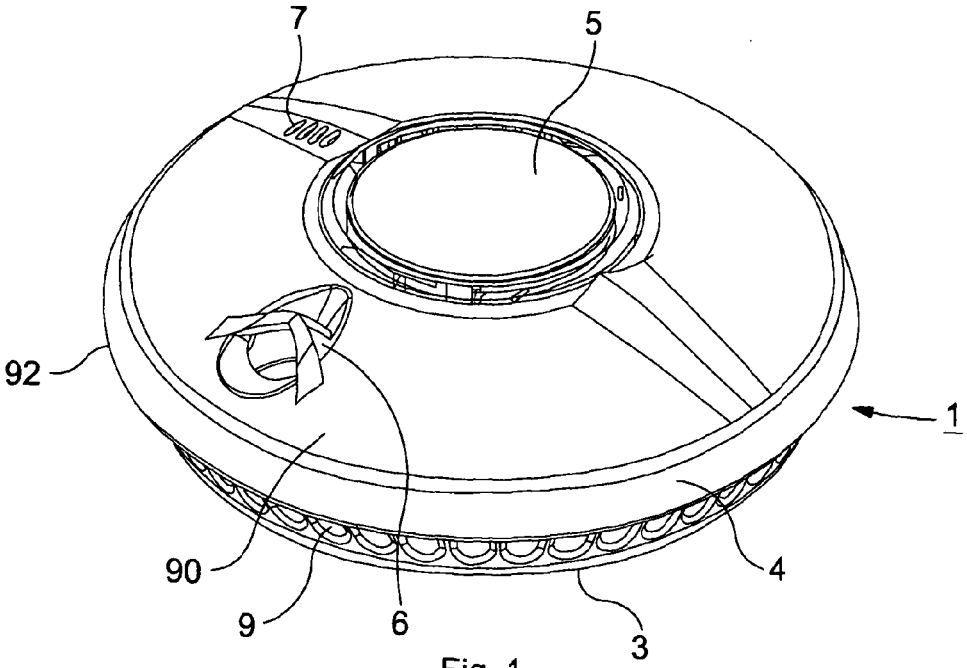
FIG. 1 is a perspective view of an alarm in accordance with and embodiment of the present invention viewed from below when mounted on a ceiling.

Referring to the drawings, FIG. 1 shows a perspective view of a preferred form of alarm 1 according to the invention. The alarm is suitable for mounting to a flat surface such as a wall or ceiling but is described here in relation to its mounting to a ceiling. The view of the alarm shown in FIG. 1 is from below when it is mounted on a ceiling. Certain aspects of the present invention to be illustrated include design detail of the alarm and this will now be described in detail.

Figure 2:
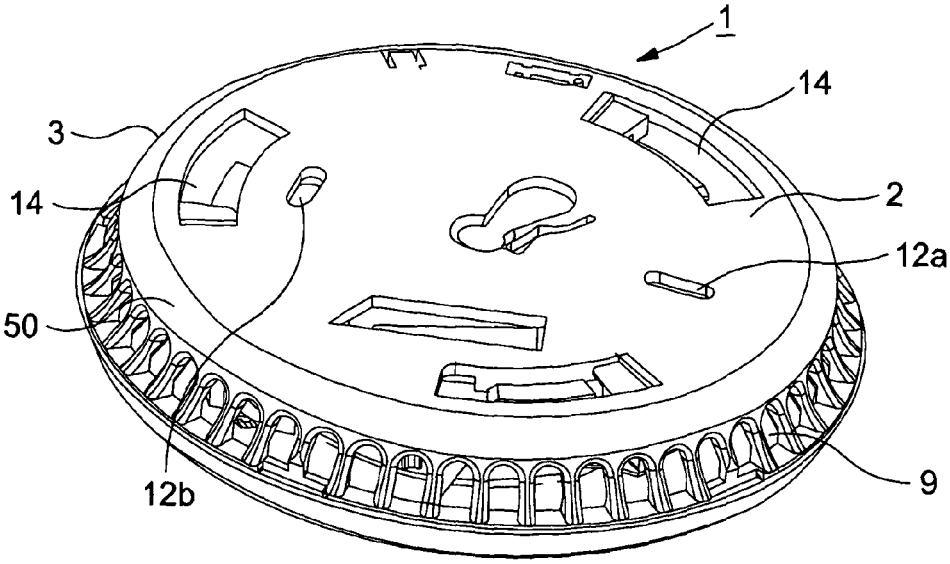
FIG. 2 is a perspective view of an upper portion of a housing of the alarm of FIG. 1, showing a mounting plate.

FIG. 2 shows the alarm 1 from the other side, namely, the side that mounts to the ceiling. The alarm 1 comprises a housing and a mounting means for mounting the housing to the ceiling. The mounting means is in the form of a mounting plate 2 which is generally circular and planar. The housing has an upper housing portion or member 3, and a lower housing portion or member 4. The terms upper and lower are relative and depend on the orientation of the alarm but are used here in the sense that applies where the alarm is attached to a ceiling.

The illustrated alarm is circular with a domed construction to give an aesthetically pleasing appearance.

The lower housing member 4 has a generally circular, domed construction with a substantially smooth outer surface 90 and rim 92. When the alarm is mounted to a flat surface this housing member 4 will be furthest from the flat surface. In the case of mounting to a ceiling, for example, the housing member 4 will face the floor. The member 4 includes, a "test function" and "silence" button 5 (the only button provided with this design of alarm) which is located at or near the apex of the dome. The housing member 4 also has a vent 6 in the surface of the dome, just below the button 5. A speaker or sounder (see FIGS. 3 to 7) is mounted adjacent the vents 6 inside the housing of the alarm. The upper housing 4 is also provided with an indicator light 7 for indicating functional states of the alarm 1.

The upper housing member 3 is generally circular and includes a generally planar base in the form of a bottom or base plate 8 with an outwardly and downwardly angled sidewall 50 extending the full periphery. The sidewall 50 has a number of openings 9 spaced around the circumference of the base plate 8. These are preferably equi-angularly spaced along the sidewall 50, although any suitable spacing may be used, and provide for ingress of smoke or pollutants incident on the alarm 1 from any direction.

Figure 4:
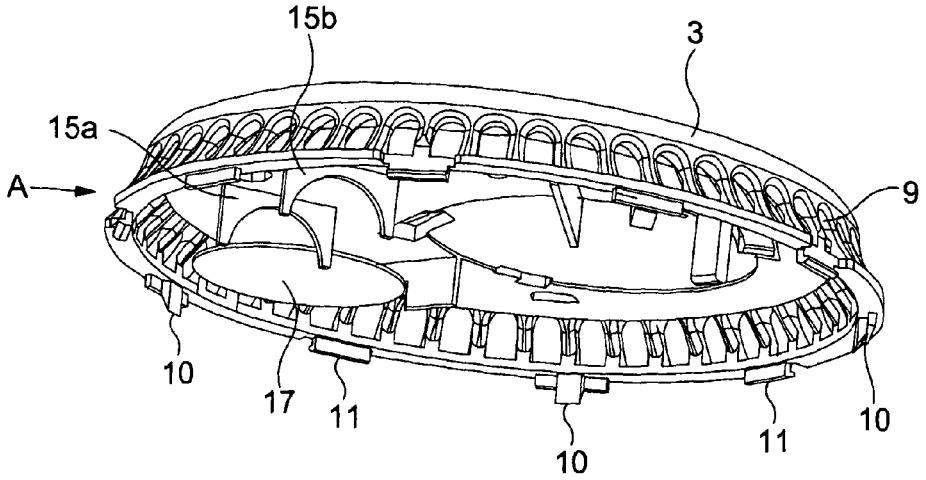
FIG. 4 is the view of the interior of the upper housing to show mountings for components of the alarm.

The lower housing member 4 and upper housing member 3 are preferably snap-fitted together by catch means preferably in the form of cooperating lugs and receptor assemblies. FIGS. 4 and 5 show locators 10 and lugs 11 positioned at points around the circumference of the housing member 3 to engage with corresponding (not shown) receptors in the lower housing member 4. In this embodiment the lug and receptor assemblies are spaced apart about the respective surfaces of the housing members 3 and 4 such that the two housing members will only snap together. Internal features of the alarm are positioned and configured to prevent incorrect assembly (Poke Yoke) in a manner known in the art. As apparent from FIG. 4, the lugs 11 are formed with a hook-like end portion. This engages in a snap-fitting manner over a shoulder formed on the corresponding receptor in the lower housing member 4.

When the housing members 3 and 4 are snapped together a space is defined between them in which the alarm circuitry, speaker or sounder and other components of the alarm can be housed. Suitable mounting means are provided for the mounting of these to the upper housing member 3 as will be described in more detail below with reference to FIGS. 4-6.

Figure 3:
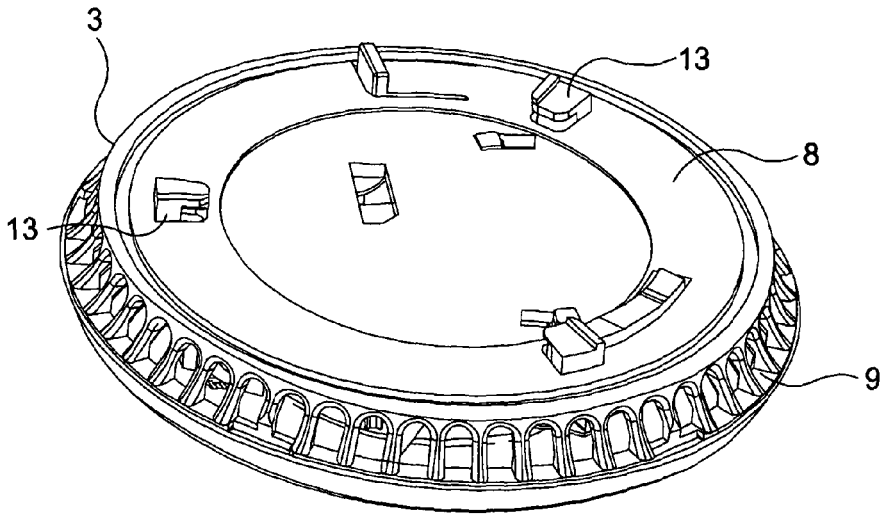
FIG. 3 is a perspective view of the upper portion without the mounting plate.

The mounting plate 2 shown in FIG. 2 is provided with apertures 12*a* and 12*b* for facilitating attachment of the plate 2 to a wall or ceiling by screws. The upper housing member 3 when detached from the mounting plate 2 is shown in FIG. 3. The base plate 8 of the housing member 3 is provided with hook-like members 13 which interlock with corresponding catches (not shown) provided in the mounting plate 2. Angular cut-outs 14 are provided in association with the catches in the mounting plate for receiving the hook-like members 13, whereby the upper housing member 3 can be secured to the mounting plate 2 after the latter has been affixed to a wall or ceiling.

FIG. 4 is a view of the interior of the upper housing 3 and is provided with battery supports 15*a* and 15*b* for supporting a battery 16 (see FIG. 6). The battery supports 15*a* and 15*b* are disposed in a radial direction so that they do not impede smoke or pollutants entering the upper housing 3 from the direction of arrow A. A piezo-electric sounder 17 is provided for generating an audible alarm when smoke or a pollutant is sensed by the alarm 1.

FIG. 5 shows the positioning of a first chamber part 22 of a sensor chamber seated on the base 23 of the upper housing 3. This may be effected by locking engagement between a pair of hook-lugs (not shown) provided on the first chamber part 22 and corresponding apertures (not shown) provided in the base 23. The first chamber part 22 comprises a substantially circular peripheral wall formed from spaced apart elongate elements comprising two groups of elements 24*a* and 24*b* respectively. These groups of elements 24*a* and 24*b* are spaced and taper inwardly into the chamber part 22 to define vents such as to provide a flow path for smoke or pollutants entering the interior of the alarm 1 via the primary vents 9 of the upper housing 3 from any direction in the plane of the base 23. One group of elements 24*a* faces generally inwardly into the upper housing 3 and the other group face generally outwardly and have different profiles from one another.

In this embodiment, a diode sensor 25 is shown within one (26*a*) of a pair of collimator housings 26*a* and 26*b*. An emitter diode (not shown) is housed within the other one of the collimator housings 26*b*. The diode sensor 25 and the diode emitter are directed towards the centre of the first chamber part 22 to optically sense the presence of smoke or other polluting agent flowing into the chamber. The profile of the first group of elements 24*a* taper inwardly towards the centre of the sensor chamber 22. The profile of the second group of elements 24*b* comprises inwardly directed tapered portions 27*a* and outwardly directed vanes 27*b* that are configured to trap external light so that light does not shine directly onto the front of the sensor and interfere with the sensor 25 or emitter. A baffle or shield 28 is situated in the centre of the sensor chamber 22 for blocking direct transmission of light between the diode sensor 25 and the emitter. The diode emitter emits light which is intended to be reflected towards the sensor diode 25 by the presence of smoke in the sensor chamber. The shield 28 comprises a double blade configuration for preventing contaminant debris, settling on one of the blades, from causing an erroneous reflection.

FIG. 6*a* shows the battery 16 in position on the battery supports 15*a* and 15*b*. These support the battery 16 in a spaced apart position relative to the base 23 of the upper housing 3 so that there is ample space to allow smoke or other pollutant entering the vents 9 from the direction of the arrow A to flow into the sensor chamber. FIG. 6*a* shows a second chamber part mounted 26 on the first chamber part 22. The second chamber part 26 has a wall that is substantially solid and so defines a closed chamber above the first chamber part 22 that is open to the flow of smoke or other pollutant though the alarm.

The first and second chamber parts 22 and 26 together form a sensor chamber of the alarm 1. The sensor chamber defines two chamber portions defined respectively by the first and second chamber parts 22 and 26. A printed circuit board (PCB) 29 is provided in between the first and second chamber parts 22 and 26 such that it extends part way into the sensor chamber. The PCB may advantageously be clamped or 'sandwiched' between the first and second chamber parts. This is apparent from FIG. 6*b* which is similar to FIG. 6*a* except that the second chamber part 26 has been removed to expose the interior of the sensor chamber and the positioning of the PCB 29 in relation to the first chamber part 22. Emitter and receiver/sensor 25 diodes are mounted onto or adjacent to a leading edge 30 of the PCB 29, the leading edge 30 of which may extend substantially half way (in this embodiment not quite half way) into the sensor chamber thus partially separating the first and second chamber parts 22 and 26. The leading edge 30 may be substantially aligned with a diameter of the sensor chamber and may be generally 'C' shaped. By mounting the collimator housings 26*a*, 26*b* (which support the emitter and receiver 25 diodes respectively) at or near the free ends of the 'C' shaped leading edge, the emitter and receiver diodes 25 are directed towards the centre of the sensor chamber 22. The PCB 29 supports alarm circuitry 32 on one side thereof that faces/extends into the lower housing 4 and so is outside the flow path of smoke or other pollutants though the upper housing 3. The PCB 29 itself is mounted to the first chamber part 22 such that it lies in a plane parallel to the base 23 but spaced therefrom so as not to impede the flow of smoke or other pollutants though the upper housing 3. In fact, the positioning of the PCB 29 may assist to direct the flow of the materials to be sensed into the sensor chamber.

This arrangement enables all the emitter and the sensor to both within the sensor chamber (as opposed to accessing it through windows, and to be integrally mounted on the PCB. This arrangement enables a simplification of the manufacture together with high reliability. As the sensors are within the sensor chamber they are less likely to be effected by anything occurring outside the light chamber and by integrating them on the PCB and sandwiching that between the two halves the PCB can be fully tested prior to insertion and the assembly is simple.

FIG. 7 is a side view of the alarm 1 with the primary vents 9 of the upper portion removed to show secondary vents 34 of the first chamber part 22 of the sensor chamber and a flow path for smoke passing through the device. The flow path is indicated by arrows C—which is a substantially planar flow path whereby smoke or other pollutants entering the housing via the primary vents of the upper housing 3 can flow along the planar flow path and into the sensor chamber via the secondary vents thereof. The construction of the embodiment described above provides for improved directionality from all directions of the alarm to the flow of smoke or other pollutants that may be incident on the alarm. This leads to an improved response time. Moreover, the alarms embodying the present invention such as the one described above, are simpler to manufacture and are more economic in terms of materials. Provision of the PCB 29 sandwiched between the first and second chamber parts 22, 26 allows for easier calibration because the smoke sensing electronics can be safely handled outside the housing.

The invention claimed is:

1. A device for detecting smoke comprising:

a housing having vents for allowing ingress of said smoke into the housing;

a sensor chamber disposed within the housing, said sensor chamber defined by a first chamber part and a second chamber part and having vents for allowing ingress of said smoke into the sensor chamber;

a sensor mounted within the sensor chamber;

an alarm circuit including a detector for detecting said smoke when sensed by the sensor; and a printed circuit board supported by the chamber parts so that it is partially sandwiched between the first chamber part and the second chamber part, such that an edge thereof extends part way into said sensor chamber so as to divide the sensor chamber into two portions, one disposed above the printed circuit board and the other below the printed circuit board, wherein said printed circuit board has the alarm circuit and the sensor mounted thereon and the sensor is mounted on, near or adjacent to said edge.

2. A device according to claim 1 wherein the housing has upper and lower housing portions and the printed circuit board supports the alarm circuitry on a side thereof that extends externally from the sensor chamber into the lower housing portion.

3. A device according claim 1, wherein the housing vents are distributed around a periphery of the housing to define a substantially planar flow path for the passage of smoke through the housing.

4. A device according to claim 3, wherein the sensor chamber is provided with vents disposed to lie at least partly within the planar flow path whereby smoke entering the housing via the housing vents can flow along the planar flow path and into the sensor chamber.

5. A device according to claim 4, wherein the printed circuit board is disposed parallel and adjacent to said planar flow path such that one of said chamber portions lies substantially within the planar flow path and the other chamber portion is offset relative to the planar flow path.

6. A device according to claim 5, wherein said other portion of the sensor chamber is substantially solid so that ingress of smoke into the chamber is by way of the vents that lie in the planar flow path.

7. A device according to claim 3, wherein the housing has upper and lower portions which couple together to provide an enclosed space for housing a battery, and a sounder and, wherein the upper and lower portions are sized so that mounting of the battery and sounder to the upper portion is such that they lie substantially outside the planar flow path of the housing.

8. A device according to claim 7, wherein supports for supporting the battery are provided and disposed substantially radially to minimise obstruction of the flow path of smoke.

9. A device according to claim 1, wherein the sensor means comprises a radiation emitting transducer for directing radiation into the sensor chamber and a radiation sensing transducer for sensing radiation reflected from smoke present in the sensor chamber.

10. A device according to claim 1 further comprising a speaker or sounder for generating an audible sound when smoke is detected by the alarm circuit.

11. A sensor chamber assembly for use as the sensor chamber of a device for detecting smoke, the sensor chamber assembly comprising:

a sensor chamber defined by a first chamber part and a second chamber part and vents for allowing ingress of smoke into the sensor chamber assembly;

a sensor mounted within the sensor chamber;

an alarm circuit including a detector for detecting said smoke when sensed by the sensor; and a printed circuit board supported by the sensor chamber assembly, so that it is at least partially sandwiched between the first chamber part and the second chamber part, such that an edge thereof extends part way into said sensor chamber so as to divide the sensor chamber into two portions one disposed above the printed circuit board and the other below the printed circuit board, wherein said printed circuit board has the alarm circuit and the sensor mounted thereon wherein the sensor is mounted on, near or adjacent to said edge.

12. A method of calibrating a sensor chamber assembly according to claim 11, the method comprising the step of simultaneously calibrating a plurality or multiplicity of said sensor chamber assemblies prior to installation within their respective housings, alongside their respective batteries and sounders.

* * * * *